US005372490A

United States Patent [19]

Fain

[11] Patent Number: 5,372,490

[45] Date of Patent: Dec. 13, 1994

[54] SCROLL COMPRESSOR OIL PUMPING SYSTEM

[75] Inventor: Gary K. Fain, Sidney, Ohio

[73] Assignee: Copeland Corporation, Sidney, Ohio

[21] Appl. No.: 83,278

[22] Filed: Jun. 28, 1993

[51] Int. Cl.[5] ..... F01M 9/00; F04C 2/00

[52] U.S. Cl. ..... 418/55.6; 418/88; 418/89; 184/6.18; 184/6.24

[58] Field of Search ..... 418/55.6, 88, 89, 94; 184/6.18, 6.24

[56] References Cited

U.S. PATENT DOCUMENTS

| | | | |
|---|---|---|---|
| 4,724,928 | 2/1988 | Lewis et al. | 184/6.18 |
| 4,877,382 | 10/1989 | Caillat et al. | 418/55 |
| 5,176,506 | 1/1993 | Siebel | 418/89 |

FOREIGN PATENT DOCUMENTS

| | | | |
|---|---|---|---|
| 0026394 | 2/1987 | Japan | 418/89 |

*Primary Examiner*—Richard A. Bertsch
*Assistant Examiner*—Charles G. Freay
*Attorney, Agent, or Firm*—Harness, Dickey & Pierce

[57] ABSTRACT

A scroll compressor oil pumping system has a concentric axial bore located in the driveshaft of the compressor which serves as the primary oil pump. The driveshaft is journaled in a lower bearing housing and is located within the oil sump of the compressor. An inlet housing is attached to the lower bearing housing and creates a stepped flow path for the oil between the sump and the oil pump. The inlet housing may also be equipped with a plurality of air foil shaped vanes to impede the formation of a bottom vortex. The stepped flow path causes an annular vortex to form which operates to separate the contaminants from the lubricating oil. In order to assist in the formation of the annular vortex, the driveshaft can include an impeller. The contaminants are channelled into a holding chamber formed by the lower bearing housing and the inlet housing. A plurality of funnel shaped orifices guide the contaminants into the chamber and operate to resist blow out of the debris during liquid flashing conditions. A magnet can be included within the holding chamber to attract the metallic contaminants if desired.

23 Claims, 4 Drawing Sheets

SCROLL COMPRESSOR OIL PUMPING SYSTEM

FIELD OF THE INVENTION

The present invention generally relates to scroll-type machinery. More particularly, the present invention relates to an improved lubricant pumping system for scroll compressors which includes a dirt trap, an oil pump and an oil screen.

BACKGROUND AND SUMMARY OF THE INVENTION

Scroll machinery for fluid compression or expansion is typically comprised of two upstanding interfitting involute spirodal wraps or scrolls which are generated about respective axes. Each respective scroll is mounted upon an end plate and has a tip disposed in contact or near contact with the end plate of the other respective scroll. Each scroll further has flank surfaces which adjoin, in moving line contact or near contact, the flank surfaces of the other respective scroll to form a plurality of moving chambers. Depending upon the relative orbital motion of the scrolls, the chambers move from the radially exterior ends of the scrolls to the radially interior ends of the scroll for fluid compression, or from the radially interior ends of the scrolls to the radially exterior ends of the scrolls for fluid expansion. The scrolls, to accomplish the formation of the chambers, are put in relative orbital motion by a drive mechanism. Either one of the scrolls may orbit or both may rotate eccentrically with respect to one another.

A typical scroll machine, according to the design which has a non-orbiting scroll, includes an orbiting scroll which meshes with the non-orbiting scroll, a thrust bearing to take the axial loads on the orbiting scroll, and a lubricant supply system for lubricating the various moving components of the machine including the thrust bearing. Accordingly, there is a continuous need in the field of scroll machines for improved lubricating techniques and systems of the scroll machinery.

Conventionally, scroll compressors utilize a large bore located within the lower portion of the crankshaft to act as a primary lubricant pump. This large bore or primary pump is in communication with a smaller bore extending from the outer circumference of the primary pump up through the top of the crankshaft to provide lubricating fluid to all the various components of the compressor which require lubrication. The lower portion of the crankshaft and thus the large bore is located within a lubricant sump in the bottom of the compressor's shell to provide a continued supply of lubricant to the primary pump.

When the primary pump draws lubricant from the sump, often included with this lubricant is a collection of debris including dirt, metal shavings, and other forms of contaminants. The primary pump will pump not only the lubricant throughout the compressor, but included with this lubricant will be the suspended pieces of debris or contaminants. Screens and filters can be provided in an attempt to clean the oil being pumped, but these screens and filters are only capable of removing the larger pieces (>0.005" diameter) of debris or contaminants. The smaller sized particles, particularly the very fine particles (<0.001" diameter), are allowed to be circulated with the lubricant throughout the bearings and thrust surfaces of the scroll compressor causing wear between the various components.

Accordingly, it would be desirable to provide a lubricant cleaning device which is capable of removing virtually all of the suspended debris and contaminants. This would then enable the lubrication system to distribute clean lubricant throughout the scroll compressor significantly increasing the life of the compressor by reducing wear.

It is therefore a primary objective of the present invention to provide an improved lubricant cleaning system which utilizes an annular vortex to trap suspended debris particles. The debris particles which are trapped in this annular vortex experience outward acceleration forces and move downward out of the vortex, towards a dirt trap area. The forces of gravity then move the debris through a plurality of funnel shaped orifices where they fall into a dirt trap holding chamber. The chamber contains an annular magnet to retain the metallic contaminants and has a volume which is of sufficient size to hold all the contaminant material normally seen by the compressor through its entire operating life.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
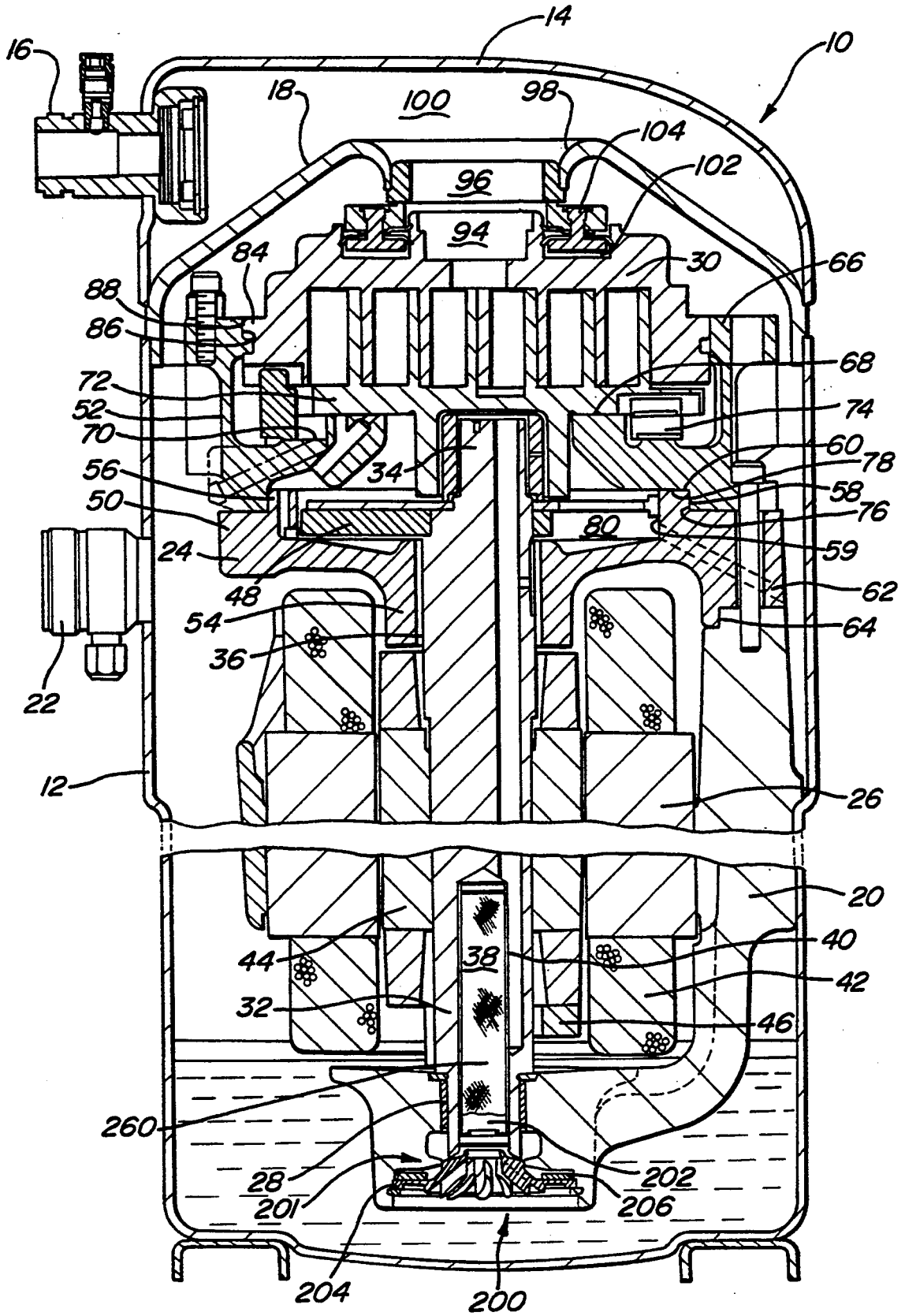
FIG. 1 is a vertical sectional view through a hermetic scroll compressor embodying the principles of the present invention.

While the present invention is suitable for incorporation into many different types of scroll machines, for exemplary purposes it will be described herein incorporated into a scroll compressor. Referring now to the drawings in which like reference numerals designate like or corresponding parts throughout the several views, there is shown in FIG. 1 a vertical sectional view of a scroll compressor 10 incorporating the lubrication system according to the present invention. Generally speaking, compressor 10 comprises a generally cylindrical hermetic shell 12 having welded at the upper end thereof a cap 14. Cap 14 is provided with a refrigerant discharge fitting 16 optionally having the usual discharge valve therein (not shown). Other elements affixed to cylindrical shell 12 include a transversely extending partition 18 which is welded about its periphery at the same point cap 14 is welded to shell 12, a lower bearing housing 20 which is affixed to shell 12 at a plurality of points by methods known well in the art, and a suction gas inlet fitting 22.

Lower bearing housing 20 locates and supports within shell 12 a main bearing housing 24, a motor stator 26, a lower bearing 28 and a non-orbiting scroll member 30. A crankshaft 32 having an eccentric crank pin 34 at the upper end thereof is rotatably journaled in lower bearing 28 in lower bearing housing 20 and in an upper bearing 36 in main bearing housing 24. Crankshaft 32 has at its lower end the usual relatively large diameter oil-pumping concentric bore 38 which communicates with a smaller diameter bore 40 extending upwardly therefrom to the top of crankshaft 32. The lower portion of cylindrical shell 12 is filled with lubricating oil in the usual manner and the pump of bore 38 at the bottom of crankshaft 32 is the primary pump acting in conjunction with bore 40 to pump lubricating fluid to all the various portions of the compressor which require lubrication as will be described later herein.

Crankshaft 32 is rotatably driven by an electric motor including motor stator 26 having motor windings 42 passing therethrough, and a motor rotor 44 press fit on crankshaft 32 and having a lower counterweight 46 and an upper counterweight 48.

Main bearing housing 24 includes a bearing cage 50 and an upper bearing housing 52. Bearing cage 50 has a generally cylindrical shaped central portion 54 within which the upper end of crankshaft 32 is rotatably supported by means of bearing 36. An upstanding annular projection 56 is provided on bearing cage 50 adjacent the outer periphery of central portion 54 and includes an accurately machined radially outwardly facing surface 58, an accurately machined radially inwardly facing surface 59 and an upwardly facing locating surface 60. A plurality of radially circumferentially spaced supporting arms 62 extend generally radially outwardly from central portion 54 and include axially extending portions adapted to engage and be supported on lower bearing housing 20. A step 64 is provided on the terminal end of the axially extending portion of each of the supporting arms 62 for engaging lower bearing housing 20. Step 64 is designed to mate with a corresponding recess provided on the abutting portion of lower bearing housing 20 for aiding in radially positioned bearing cage 50 with respect to lower bearing housing 20.

Upper bearing housing 52 of main bearing housing 24 is generally cup-shaped including an upper annular guide ring portion 66 integrally formed therewith, an annular axial thrust bearing surface 68 disposed below ring portion 66, and a second annular supporting bearing surface 70 positioned below and in radially outwardly surrounding relationship to axial thrust bearing surface 68. Axial thrust bearing surface 68 serves to axially movably support an orbiting scroll member 72, and supporting bearing surface 70 provides support for an Oldham coupling 74. The lower end of upper bearing housing 52 includes an annular recess defining radially inwardly and axially downwardly facing surfaces 76, 78 respectively which are designed to mate with surfaces 58 and 60 respectively of bearing cage 50 to aid in axially and radially positioning bearing cage 50 and upper bearing housing 52 relative to each other. Additionally, a cavity 80 is designed to accommodate rotational movement of upper counterweight 48 secured to crankshaft 32 at the upper end thereof. The provision of this cavity enables counterweight 48 to be positioned in closer proximity to orbiting scroll member 72 thus enabling the overall size thereof to be reduced.

Annular integrally formed guide ring 66 is positioned in surrounding relationship to a radially outwardly extending flange portion 84 of non-orbiting scroll member 30 and includes a radially inwardly facing surface 86 adapted to abut a radially outwardly facing surface 88 of flange portion 84 so as to radially and axially position non-orbiting scroll member 30.

Non-orbiting scroll member 30 has a centrally disposed discharge passageway 94 communicating with an upwardly open recess 96 which is in fluid communication via an opening 98 in partition 18 with a discharge muffler chamber 100 defined by cap 14 and partition 18. Non-orbiting scroll member 30 further has in the upper surface thereof an annular recess 102 having parallel coaxial side walls in which is sealingly disposed for relative axial movement an annular floating seal 104 which serves to isolate the bottom of recess 102 from the presence of gas under suction and discharge pressure so that it can be placed in fluid communication with a source of intermediate fluid pressure by means of a passageway (not shown). Non-orbiting scroll member 30 is thus axially biased against orbiting scroll member 72 by the forces created by discharge pressure acting on the central portion of non-orbiting scroll member 30 and those created by intermediate fluid pressure acting on the bottom of recess 102. This axial pressure biasing, as well as other various techniques for supporting scroll member 30 for limited axial movement, are disclosed in much greater detail in assignee's U.S. Pat. No. 4,877,382, the disclosure of which is hereby incorporated herein by reference.

Relative rotation of the scroll members is preferably prevented by the usual Oldham coupling 74 of the type disclosed in the above referenced U.S. Pat. No. 4,877,382, however, the coupling disclosed in assignee's copending application Ser. No. 591,443 entitled "Oldham Coupling for Scroll Compressor" filed Oct. 1, 1990, the disclosure of which is hereby incorporated herein by reference, may be used in place thereof.

The compressor is preferably of the "low side" type in which suction gas entering via gas inlet 22 is allowed, in part, to escape into shell 12 and assist in cooling the motor. So long as there is an adequate flow of returning suction gas the motor will remain within desired temperature limits. When this flow drops significantly, however, the loss of cooling will eventually cause a temperature sensor to signal the control device and shut the machine down.

Figure 2:
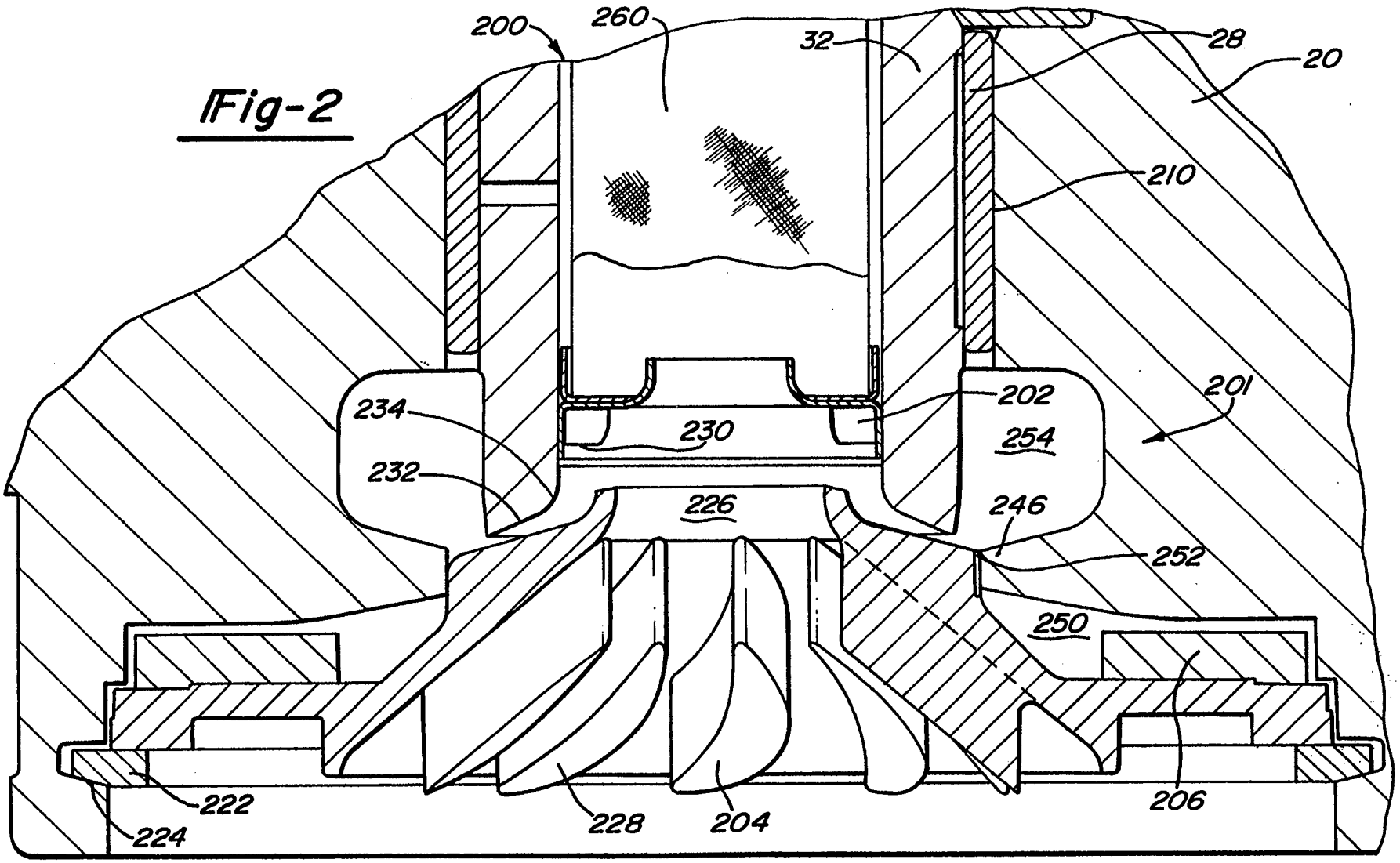
FIG. 2 is an enlarged vertical cross sectional view showing the area adjacent the lower end of the compressor of FIG. 1 embodying the principles of the present invention.
Figure 3:
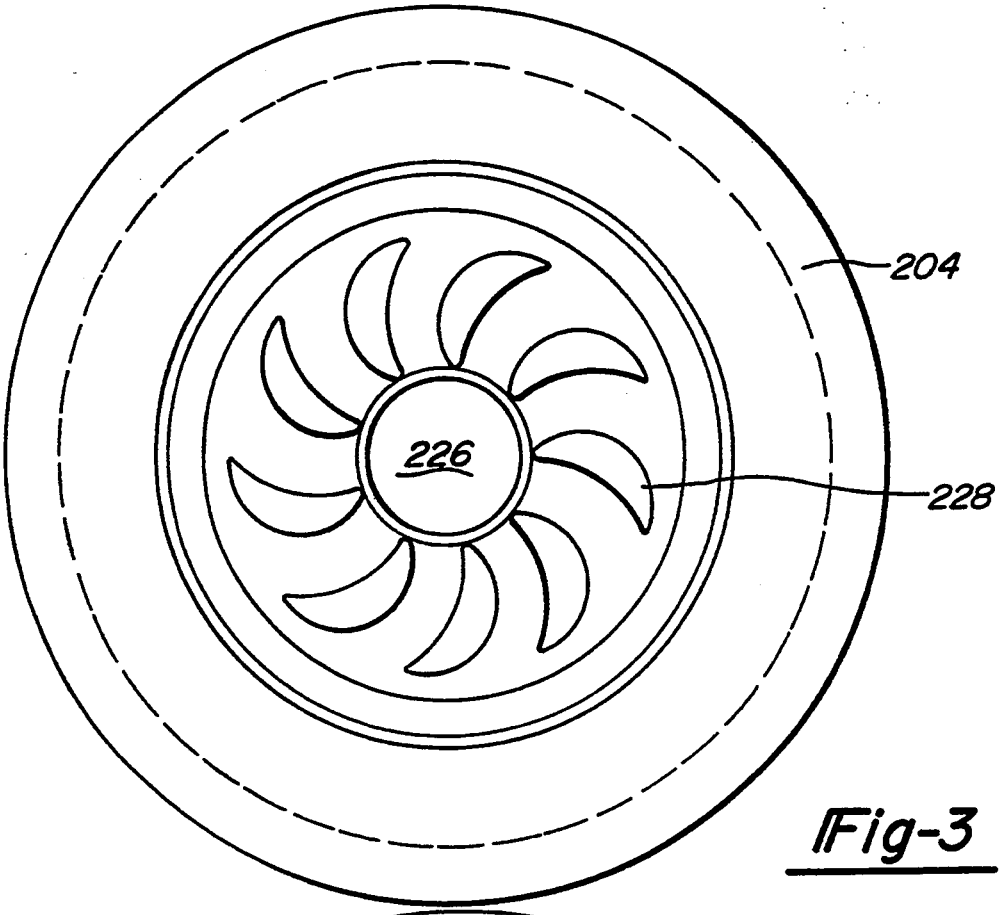
FIG. 3 is a bottom plan view of the dirt trap according to the present invention.
Figure 4:
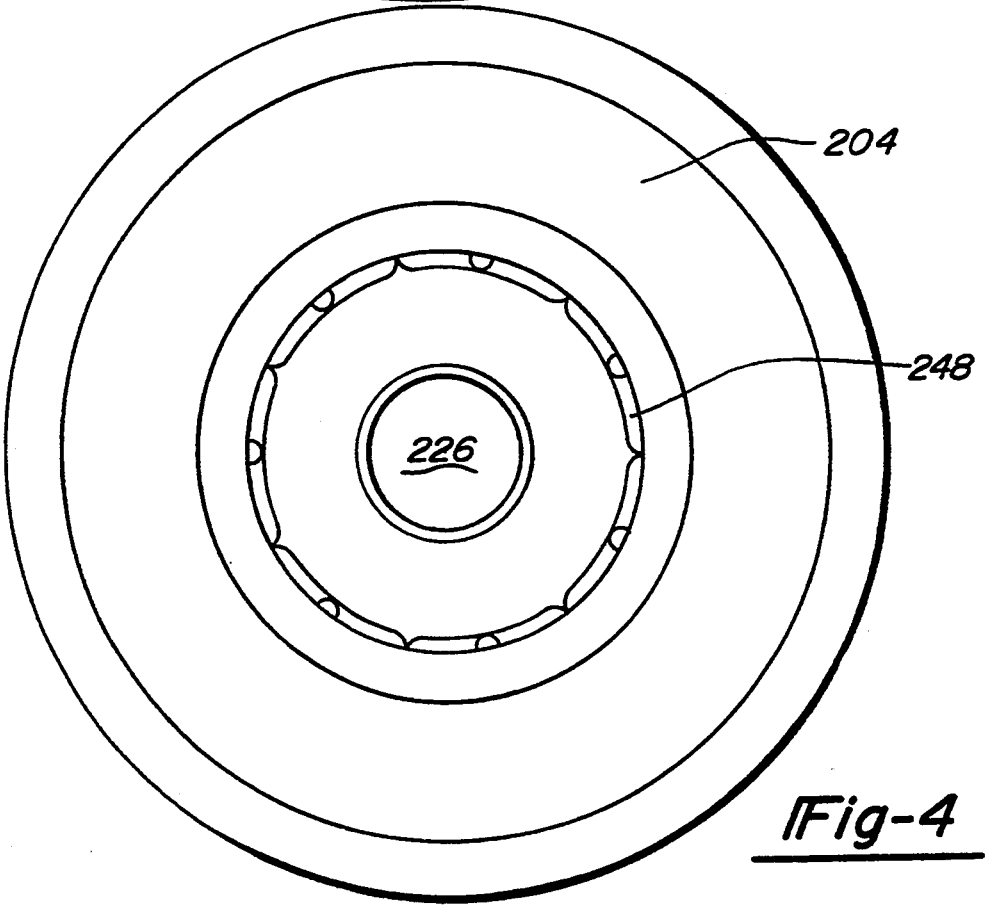
FIG. 4 is a top plan view of the dirt trap according to the present invention.
Figure 5:
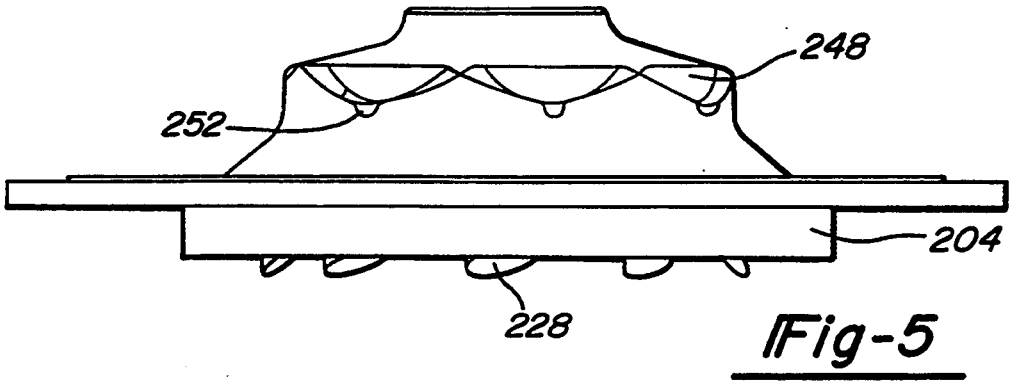
FIG. 5 is a side elevational view of the dirt trap according to the present invention.

The scroll compressor as thus far broadly described is either now known in the art or is the subject matter of other pending applications for patent by applicant's assignee. The details of construction which incorporate the principles of the present invention are those which deal with a unique lubrication pumping system, indicated generally at 200. Lubrication pumping system 200 includes, in the usual manner, the pump at the bottom of crankshaft 32 in the form of concentric bore 38 which acts as the primary pump acting in conjunction with bore 40 to pump lubricating fluid to all the various portions of the compressor which require lubrication. In addition, lubrication pumping system 200 as best shown in FIG. 2 further includes a debris and contaminant separation system 201 which is comprised of an oil impeller or flinger 202, an inlet housing 204 and a magnet 206.

As described above, lower bearing housing 20 houses lower bearing 28 which rotatably journals crankshaft 32. Lower bearing 28 is disposed in a generally vertical bore 210 located in lower bearing housing 20. Directly below bore 210, bearing housing 20, crankshaft 32 and inlet housing 204 cooperate to form debris and contaminant separation system 201. Inlet housing 204 is preferably an injection molded plastic component which is positioned within lower bearing housing 20 directly below bore 210. A tapered snap ring 222 is positioned within a tapered snap ring groove 224 to hold inlet housing 204 in position. Inlet housing 204 has a centrally located opening 226 extending through it to provide lubricant to the inlet of concentric bore 38, the primary pump for compressor 10. The lower surface of inlet housing 204 has a plurality of vanes 228 formed in the shape of an air foil. Vanes 228 operate to prevent an unwanted bottom vortex from forming which would reduce the primary pump's head.

Figure 6:
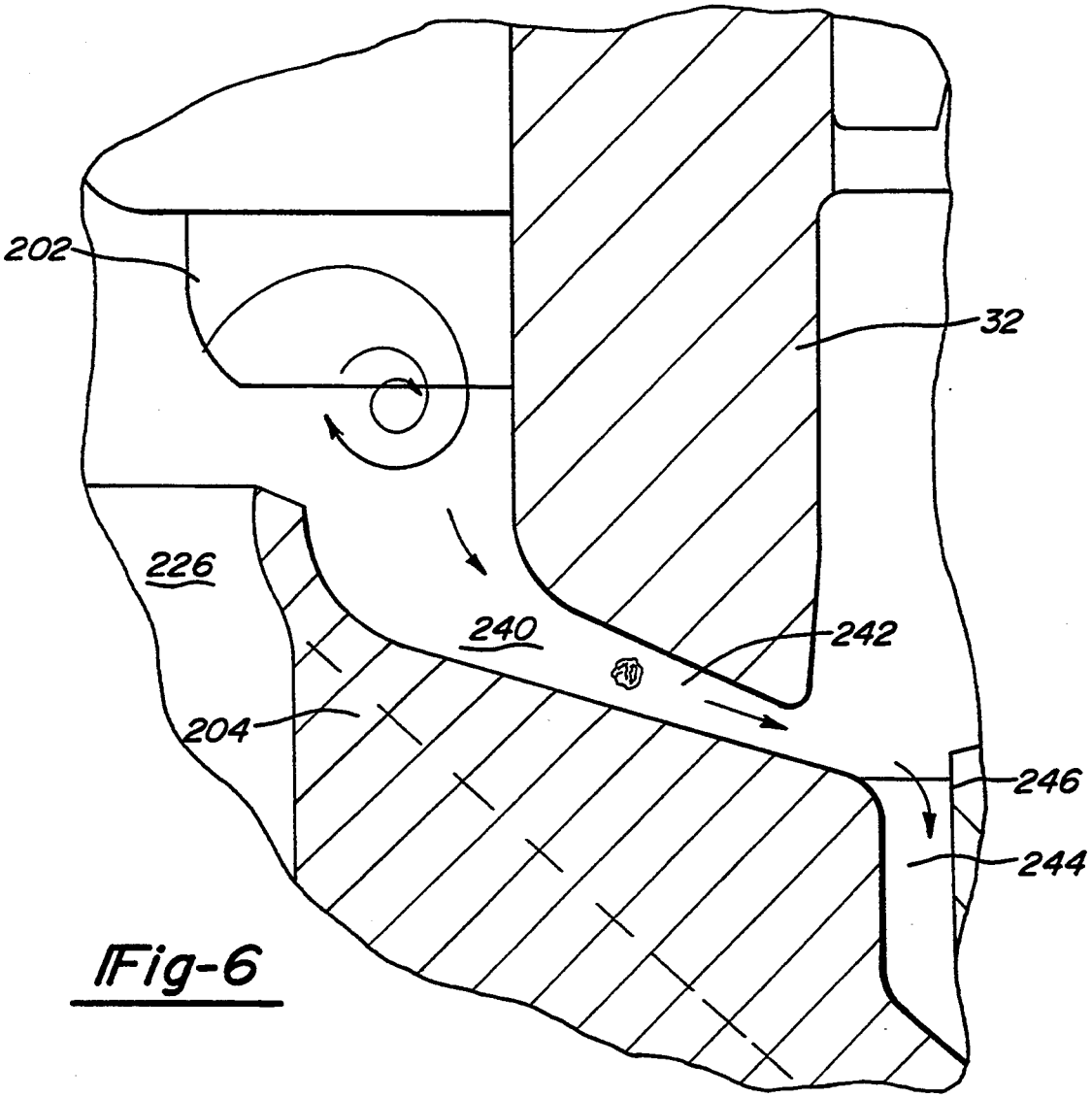
FIG. 6 is an enlarged cross sectional view showing the debris path according to the present invention.

Impeller 202 is secured within bore 38 by a press fitting or other means known in the art at a position slightly upward from centrally located opening 226 in input housing 204. Thus, impeller 202 is positioned slightly above the bottom of the oil inlet to crankshaft 32. In the preferred embodiment this distance is approximately 2 to 3 mm. This spacing of impeller 202 leaves the inlet bottom edge 230 of impeller 202 open and unable to support a radial pressure gradient along its bottom edge 230. A strong recirculation flow develops as shown by the arrows in FIG. 6 which produces an annular vortex along the bottom inside diameter of crankshaft 32. This swirling vortex would occur to some extent without impeller 202 due to the separation of flow downstream of opening 226, but the addition of impeller 202 assists in the formation and strength of the vortex. The lower end of crankshaft 32 which includes concentric bore 38 is tapered at 232 leading to a radiused section 234 which then opens into bore 38. The tapered, radiused shaft end reduces squeeze film pressure reduction during the start-up, upward jump of crankshaft 32.

Debris and contaminants swirling in this strong vortex experience outward acceleration forces and move downward out of the vortex and into an inlet area 240 formed between crankshaft 32 and inlet housing 204. The separated debris and contaminants are then centrifugally pulled into the shear area 242 between the bottom of rotating crankshaft 32 and the top surface of the stationary inlet housing 204. Impeller 202 imparts some of the circumferential swirl to the lubricant and the lubricant located between crankshaft 32 and inlet housing 204 will swirl at a reduced speed to that of crankshaft 32. Centrifugal force moves the separated debris and contaminants outward to the plurality of funnel shaped orifices 244 formed by inlet housing 204 and an annular wall 246 formed in lower bearing housing 20. Annular wall 246 forms the outer surface of the plurality of orifices 244 while a plurality of funnel shaped undercuts 248 formed in the outer surface of inlet housing 204 complete the formation of the plurality of funnel shaped orifices 244. The plurality of funnel shaped orifices 244 direct this debris and contaminants to a holding chamber 250 formed between lower bearing housing 20 and inlet housing 204. The debris and contaminants move through funnel shaped orifices 244 due to the forces of gravity. This movement is also assisted by micro vortices that form in each of the plurality of funnel shaped orifices 244.

Once the debris and contaminants enter holding chamber 250 they are dispersed by both the micro vortices in orifices 244 and the vibration of compressor 10. Magnetic particles such as cast iron will attach to magnet 206 disposed within holding chamber 250. The volume of chamber 250 is sized to hold the normal amount of debris and contaminants encountered during the normal operational life of compressor 10.

With the debris and contaminants now being located within holding chamber 250, it is now important to prevent this collected debris and contaminants from being "blown out" during liquid flashing from defrost or liquid start-up conditions. Funnel shaped orifices 244 terminate in a relatively small diameter hole 252 which preferably is approximately 0.035 inches in diameter at the small end of the funnel. This small diameter hole 252 is restrictive to the "blowing out" of the debris and contaminants. In addition, the "flash off" of the damper volume in a chamber 254 defined by crankshaft 32 and lower bearing housing 20 provides a back pressure which allows pressure within holding chamber 250 to gradually boil off and thus be less of a disturbance to the material located within holding chamber 250.

Debris and contaminant separation system 201 is an inertial type of separator. It is capable of separating very fine particles from the lubricant (<0.001"). System 201 will catch silt that a prior art screen or filter will not. While it is to be understood that separation system 201 cannot catch all of the debris and contaminants on the first pass, continuous passes through compressor 10 will eventually clean the lubricant. Also, oil flow near the centerline of crankshaft 32 is unaffected by the vortex thus leading to the requirement of continuous passes of the lubricant. To aid in the cleaning of the lubricant, a fine mesh lubricant screen 260 is installed inside bore 38 of crankshaft 32 to catch the larger particles of debris. Preferably the screen 260 is a fine #150 mesh screen capable of stopping particles greater than 0.004 inches in diameter. Screen 260 is geometrically designed with a large number of sharp pointed folds to maximize the area of screen 260 and thus reduce the flow loss. This design of screen 260 also aids in the trapping of the debris. Since screen 260 is rotating with crankshaft 32, debris will move toward the outer part of the fold and pack into that area. Screen 260 is capable of trapping the larger sizes of particles but it will not be able to trap the finer particles. Thus screen 260 serves to minimize the amount of circulated debris while debris and contaminant separation system 201 works to eliminate all forms of debris.

Operation of the pumping system begins with the lubricant located in the bottom of shell 12. As crankshaft 32 is rotated, concentric bore 38 begins pumping lubricant from the bottom of shell 12 through bore 38 through bore 40, throughout compressor 10 and back into the bottom of shell 12 through various ports (not shown). The lubricant leaves the bottom of shell 12, works its way through the plurality of vanes 228 of inlet housing 204. The lubricant continues up and through opening 226 in inlet housing 204. A portion of the lubricant proceeds up bore 38 while a second portion is caught by the strong vortex created by impeller 202. The oil caught in the strong vortex by impeller 202 goes through the lubricant cleaning process as described above.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having on one side a first spiral vane;

a second scroll member having a second spiral vane disposed in interengaging relationship with said first spiral vane so that as said first scroll member orbits with respect to said second scroll member, moving pockets of changing volume are formed by said vanes;

drive means for causing said scroll members to orbit with respect to one another;

oil supply means for supplying lubricating oil from a sump to moving components of said scroll machine;

means for removing contaminants from said lubricating oil and accumulating said contaminants in a chamber, said means for removing contaminants including a device for forming a vortex for separating said contaminants from said lubricating oil, said means for removing contaminants being powered by said oil supply means; and means for preventing said contaminants from leaving said chamber and returning to said sump.

2. The scroll compressor according to claim 1 further comprising a magnet disposed within said chamber.

3. The scroll machine according to claim 1 wherein said oil supply means includes a shaft rotating within said sump, said shaft defining an axially extending bore which serves as a primary oil pump for said oil supply means.

4. The scroll machine according to claim 3 wherein said shaft is a driveshaft associated with said drive means.

5. The scroll machine according to claim 3 wherein said device for forming a vortex comprises a stepped flowpath between said sump and said axially extending bore within said shaft, said stepped flowpath causing said vortex.

6. The scroll machine according to claim 5 wherein said stepped flowpath is formed by said means for preventing said contaminants from leaving said chamber.

7. The scroll machine according to claim 5 further comprising an impeller disposed within said axially extending bore, said impeller being secured to said shaft for rotation therewith and operable to assist in the formation of said annular vortex.

8. The scroll machine according to claim 5 wherein said shaft and said means for preventing said contaminants from leaving said chamber forms an annular path between said annular vortex and said chamber.

9. The scroll compressor according to claim 1 wherein said means for preventing said contaminants from leaving said chamber comprises an annular member having an inlet end and an outlet end, said annular member being secured to a housing of said scroll machine and in conjunction with said housing of said scroll machine defining said chamber.

10. The scroll compressor according to claim 9 further comprising a magnet disposed within said chamber.

11. The scroll compressor according to claim 9 wherein said inlet end of said compressor defines a plurality of air foil shaped vanes.

12. The scroll compressor according to claim 11 wherein said plurality of vanes impart a negative swirl to the lubricant moving between said inlet end and said outlet end of said annular member.

13. The scroll compressor according to claim 9 wherein said annular member and said scroll machine form a plurality of funnel shaped orifices, said plurality of funnel shaped orifices defining a path for said contaminants between said means for removing contaminants and said annular cavity.

14. The scroll compressor according to claim 1 wherein said means for removing contaminants includes a screen.

15. A scroll machine comprising:

a first scroll member having on one side a first spiral vane;

a second scroll member having a second spiral vane disposed in intervening relationship with said first spiral vane so that as said first scroll member orbits with respect to said second scroll member, moving pockets of changing volume are formed by said vanes;

drive means for causing said scroll members to orbit with respect to one another, said drive means including a drive shaft having a first end extending into a lubricant located in a sump of said scroll machine and defining an axial bore extending from said first end, said axial bore serving as a primary oil pump for said scroll machine, said driveshaft being rotatably journaled in a lower bearing housing;

a dirt trap fixedly secured to said lower bearing housing and defining a lubricant flow path between said sump and said axial bore, said flow path having an inlet end and an outlet end and being stepped at said outlet end to create an annular vortex in a portion of the lubricant being pumped from said sump to said axial bore, said annular vortex being operable to separate contaminants from said lubricant, said dirt trap and said driveshaft forming an annular passage for said separated contaminants between said annular vortex and a cavity defined by said dirt trap and said lower bearing housing.

16. The scroll machine according to claim 15 further comprising a magnet disposed in said cavity formed by said dirt trap and said lower bearing housing.

17. The scroll machine according to claim 15 further comprising an impeller disposed within said axial bore, said impeller being secured to said driveshaft for rotation therewith and operable to assist in the formation of said annular vortex.

18. The scroll machine according to claim 15 wherein said dirt trap includes a plurality of air foil shaped vanes disposed at said inlet end of said lubricant flow path, said plurality of vanes being operable to impart a negative swirl to said lubricant being pumped between said sump and said axial bore.

19. The scroll machine according to claim 15 wherein said dirt trap is formed from plastic.

20. The scroll machine according to claim 15 wherein said dirt trap and said lower bearing housing further define a plurality of funnel shaped orifices disposed between said annular passage and said cavity.

21. The scroll machine according to claim 15 further comprising a screen disposed within said lubricant flow path.

22. A scroll machine comprising:

a first scroll member having on one side a spiral vane;

a second scroll member having a second spiral vane disposed in interengaging relationship with said first spiral vane so that as said first scroll member orbits with respect to said second scroll member, moving pockets of changing volume are formed by said vanes;

drive means for causing said scroll members to orbit with respect to one another;

oil supply means for supplying lubricating oil from a sump to moving components of said scroll machine;

means for removing contaminants from said lubricating oil, said means for removing contaminants being powered by said oil supply means; and means for holding a specified volume of said contaminants in communication with said means for removing contaminants, said means for holding a specified volume of said contaminants comprising an annular member having an inlet end and an outlet end, said annular member being secured to a housing of said scroll machine and in conjunction with said housing of said scroll machine defining a generally annular cavity for holding said debris.

23. A scroll machine comprising:

a first scroll member having on one side a first spiral vane;

a second scroll member having a second spiral vane disposed in inter-engaging relationship with said first spiral vane so that as said first scroll member orbits with respect to said second scroll member, moving pockets of changing volume are formed by said vanes;

drive means for causing said scroll members to orbit with respect to one another;

oil supply means for supplying lubricating oil from a sump to moving components of said scroll machine;

means for removing contaminants from said lubricating oil, said means for removing contaminants including a device for forming a vortex for separating said contaminants from said lubricating oil, said means for removing contaminants being powered by said oil supply means; and means for holding a specified volume of said contaminants in communication with said means for removing contaminants.

* * * * *